US006957140B1

(12) United States Patent
Bauerle et al.

(10) Patent No.: US 6,957,140 B1
(45) Date of Patent: Oct. 18, 2005

(54) LEARNED AIRFLOW VARIATION

(75) Inventors: Paul A. Bauerle, Fenton, MI (US); Joseph M. Stempnik, Warren, MI (US); Kerfegar K. Katrak, Fenton, MI (US); Donovan L. Dibble, Utica, MI (US); Alfred E. Spitza, Jr., Brighton, MI (US); James L. Worthing, Munith, MI (US); John N. Stockbridge, Novi, MI (US); Edward J. Tully, Royal Oak, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/891,462

(22) Filed: Jul. 14, 2004

(51) Int. Cl.[7] ..... F02D 41/14
(52) U.S. Cl. ..... 701/110; 123/399
(58) Field of Search ..... 701/115, 110, 102, 701/93, 95; 123/399, 361

(56) References Cited

U.S. PATENT DOCUMENTS 4,227,507 A * 10/1980 Takase et al. ..... 123/492
4,577,603 A * 3/1986 Murakami et al. ..... 123/339.17
4,640,254 A * 2/1987 Ninomiya ..... 123/492
6,390,055 B1 * 5/2002 Sivashankar et al. ..... 123/295
6,698,398 B2 3/2004 Bauerle ..... 123/399

FOREIGN PATENT DOCUMENTS

JP 61-123731 * 6/1986 ..... F02D 41/14

* cited by examiner

*Primary Examiner*—Hieu T. Vo
(74) *Attorney, Agent, or Firm*—Christopher DeVries

(57) ABSTRACT

A throttle control system for a vehicle includes a driver input that generates a control signal and a control module that generates a throttle control signal based on the control signal. The control module determines whether the throttle control signal is within one of a first and a second region, determines a compensation factor from a first look-up table when the throttle control signal is within the first region and determines the compensation factor from a second look-up table when the throttle control signal is within the second region. The control module calculates a compensated throttle control signal based on the compensation factor.

37 Claims, 8 Drawing Sheets

LEARNED AIRFLOW VARIATION

FIELD OF THE INVENTION

The present invention relates to engine throttle control systems, and more particularly to a throttle control system that compensates for an area of a throttle body.

BACKGROUND OF THE INVENTION

Electronic throttle control (ETC) systems replace the mechanical pedal assemblies that are currently used in vehicles. ETC systems enhance overall engine management while reducing the cost of the vehicle. Traditional engine controls rely on direct input from drivers and numerous valves and linkages to manage the engine. These systems do not enable consistent throttle control.

ETC sensors eliminate the linkage that is used to connect the accelerator pedal to the throttle body. ETC sensors take input from the driver and send it to an engine control system in real time. The engine control system modulates the air/fuel flow to the engine. Direct control of the engine is shifted from the driver to the engine control system to improve efficiency.

ETC can also be coordinated with the shifting of the transmission, whereas mechanical systems react solely to the torque applied by the engine. Mechanical systems shift under high-load conditions, which may decrease the life of the transmission over time. ETC systems can reduce throttle, shift, and then increase throttle. This approach will increase the life of the transmission.

As throttle body coke deposits build up on a throttle blade/bore during the life of a vehicle, a relationship between pedal position and throttle response may deteriorate. This deterioration can lead to reduced idle quality. Customers experiencing poor idle quality during a warranty coverage period will request service. As a result, the warranty cost of the vehicle increases. Customers experiencing poor idle quality after the warranty coverage period ends will have higher operating costs. Other conditions that may adversely impact throttle response include variations in an airflow breakout region position, dirty air cleaners, and/or non-linearity in throttle position sensors.

SUMMARY OF THE INVENTION

Accordingly, the present invention provides a throttle control system for a vehicle. The throttle control system includes a driver input device that generates a control signal and a control module that generates a throttle control signal based on the control signal. The control module determines whether the throttle control signal is within one of a first and a second region, determines a compensation factor from a first look-up table when the throttle control signal is within the first region and determines the compensation factor from a second look-up table when the throttle control signal is within the second region. The control module calculates a compensated throttle control signal based on the compensation factor.

In one feature, the throttle control system further includes a throttle that is regulated based on the compensated throttle control signal.

In another feature, the driver input device includes one of an accelerator pedal and a cruise control system.

In another feature, the control module stores the compensation factor in first and second memory stores and determines whether to rate limit the compensation factor. The control module compares compensation factor values from the first and second stores to determine whether the compensation factor was rate limited.

In other features, the control module checks learning conditions. The control module updates the first look-up table based on a mass air flow (MAF) residual when the learning conditions are met and the throttle control signal is in the first region and updates the second look-up table based on the MAF residual when the learning conditions are met and the throttle control signal is in the second region. The control module updates the first and second tables based on the MAF residual when the learning conditions are met and an update index is common to both the first and second tables.

In another feature, the throttle control system further includes a MAF sensor that generates a measured MAF signal. The MAF residual is calculated based on the measured MAF signal.

In another feature, the throttle control system further includes a manifold absolute pressure (MAP) sensor that generates a measured MAP signal. The MAF residual is calculated based on the measured MAP signal.

In another feature, the control module updates a first residual look-up table based on the MAF residual when the learning conditions are met and the throttle control signal is in the first region and updates a second residual look-up table based on the MAF residual when the learning conditions are met and the throttle control signal is in the second region.

In another feature, the control module determines a first mass air flow (MAF) residual from a residual look-up table, determines a second MAF residual from the residual look-up table and enables a barometer update routine when the first and second MAF residuals are each less than a barometer update enable threshold.

In still another feature, the control module resets one of the first and second look-up tables when a size of at least one of the first and second look-up tables is not equal to a predetermined value.

In yet another feature, the control module resets one of the first and second look-up tables when the compensation factor is outside of a threshold range. The control module determines upper and lower limits of the threshold range.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
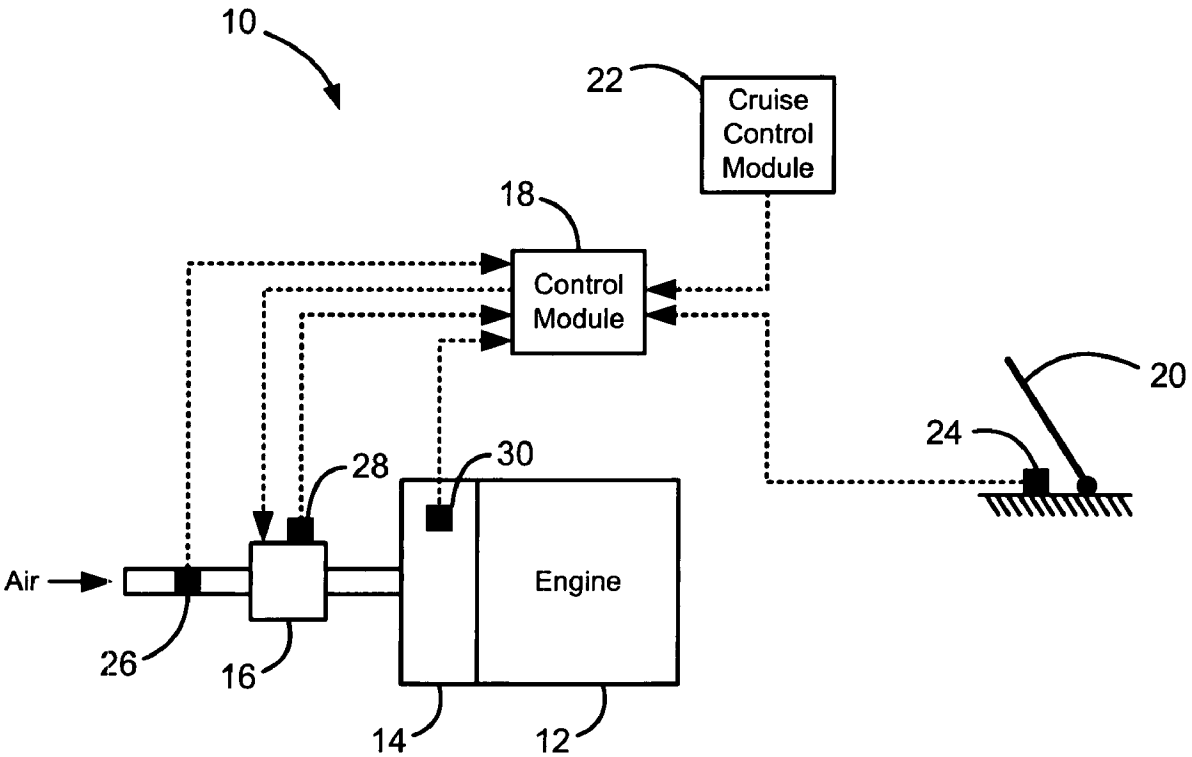
FIG. 1 is a schematic illustration of an exemplary vehicle that is operated based on the throttle control system according to the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

The present invention uses a throttle area correction factor ($A_{CORR}$) and mass air flow (MAF) residuals that are generated by an intake diagnostic system to compensate a throttle body for actual airflow progression throughout multiple operating ranges of a throttle blade opening. Generally, the present invention employs the throttle body airflow relationship (or progression) for an ideal throttle body and creates and updates a series of look-up tables used to compensate the ideal throttle body. The throttle control system of the present invention expands upon and provides more advanced functions than the throttle control system of commonly assigned, co-pending U.S. patent application Ser. No. 10/689,184, filed Oct. 20, 2003 and entitled Airflow Variation Learning Using ETC, the disclosure of which is expressly incorporated herein be reference.

Referring now to FIG. 1, a vehicle 10 is schematically illustrated. The vehicle 10 is driven by an engine 12 that combusts an air and fuel mixture to produce drive torque. Air is drawn into an intake manifold 14 through a throttle 16. A position of a throttle blade defines a throttle area across which air flows into the intake manifold 14. The air within the intake manifold 14 is distributed to cylinders (not shown) and is mixed with fuel for combustion.

Overall operation of the engine 12 is monitored and regulated by a control module 18. More specifically, the control module 18 regulates the engine 12 based on driver inputs and engine operating conditions. The driver inputs include an accelerator pedal 20 and/or a cruise control module 22. A pedal sensor 24 is responsive to a position of the accelerator pedal 20 and generates a pedal position signal to the control module 18. The accelerator pedal position is indicative of a desired engine torque output from the driver. The cruise control module 22 signals desired engine torque output based on a set point set by the driver. A mass air flow (MAF) sensor 26 is responsive to the MAF through the throttle 16 and generates a MAF signal to the control module 18. A throttle position sensor (TPS) 28 is responsive to the position of the throttle blade and generates a TPS signal to the control module 18. A manifold absolute pressure (MAP) sensor 30 is responsive to a pressure within the intake manifold 14 and generates a MAP signal to the control module 18.

The throttle control system of the present invention regulates the throttle position based on a compensated throttle area ($A_{COMP}$). $A_{COMP}$ accounts for variations in the throttle body and/or engine system as a whole to provide the desired engine torque output. More specifically, an uncompensated throttle area ($A_{UNCOMP}$) is generated based on driver and/or cruise control intent. $A_{UNCOMP}$ does not account for airflow variations through the throttle body. The throttle control system determines whether $A_{UNCOMP}$ is within a low airflow (LO) region or a high air airflow (HI) region by comparing $A_{UNCOMP}$ to respective thresholds.

A throttle area correction factor ($A_{CORR}$) is determined from a look-up table based on $A_{UNCOMP}$. More specifically, if $A_{UNCOMP}$ is in the LO region, $A_{CORR}$ is determined from a LO region look-up table. If $A_{UNCOMP}$ is in the HI region, $A_{CORR}$ is determined from a HI region look-up table. The following is an exemplary LO region look-up table:

| $A_{UNCOMP}$ (%) | $A_{CORR}$ | Index |
|---|---|---|
| 0 | $A_{CORR0} = 0$ | 0 |
| 5 | $A_{CORR1} = 0.3$ | 1 |
| 10 | $A_{CORR2} = 0.5$ | 2 |
| 15 | $A_{CORR3} = 0.6$ | 3 |
| 20 | $A_{CORR4} = 0.4$ | 4 |
| 30 | $A_{CORR5} = 0.3$ | 5 |
| 50 | $A_{CORR6} = 0.3$ | 6 |
| . . . | . . . | . . . |
| $A_{UNCOMPn}$ | $A_{CORRn}$ | $INDEX_n$ |

It is appreciated that the values provided in the table are merely exemplary in nature. The LO and HI region look-up tables overlap and include a common break point or index. More specifically, the last index of the LO region look-up table includes the same values as the first index of the HI region look-up table. The throttle control system further includes a LO region residual look-up table and a HI region residual look-up table, which respectively correspond to the LO region and HI region look-up tables. The residual look-up tables are implemented in an updating or learning routine, discussed in further detail below.

$A_{CORR}$ and the index are determined based on $A_{UNCOMP}$. More specifically, if $A_{UNCOMP}$ is between index values, the throttle control system interpolates $A_{CORR}$. If $A_{UNCOMP}$ is below the first index, the first index is value used. If $A_{UNCOMP}$ is above the last index, the last index value is used. $A_{COMP}$ is determined based on $A_{UNCOMP}$ and $A_{CORR}$ and the throttle position is determined based on $A_{COMP}$. In this manner sufficient airflow is enabled to provide the desired engine torque output.

The LO region and HI region look-up tables and corresponding residual tables are concurrently updated when learning conditions are appropriate. More specifically, the throttle control system checks to ensure that the vehicle is operating in a stable state and that there are no sensor faults. In particular, the throttle control system compares a measured MAF ($MAF_{MEAS}$) to a calculated MAF ($MAF_{CALC}$) to ensure the MAF sensor is not shifted. $MAF_{MEAS}$ is determined based on the MAF signal from the MAF sensor and $MAF_{CALC}$ is calculate based on the MAP, which is determined from the MAP sensor.

Figure 2:
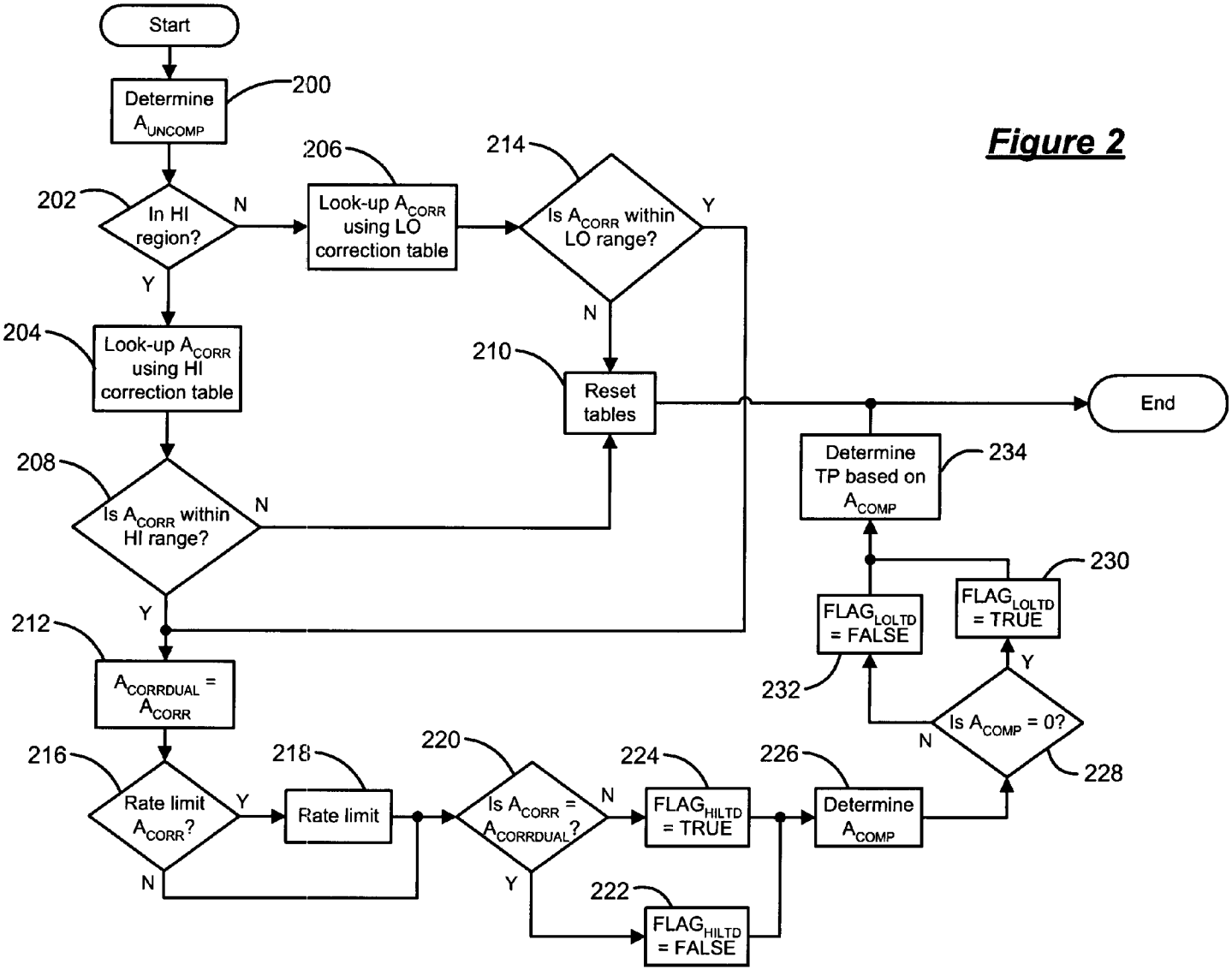
FIG. 2 is a flowchart illustrating steps performed by the throttle control system to determine a throttle position based on an uncompensated throttle area according to the present invention.

Referring now to FIG. 2, the steps performed by the throttle control system will be discussed in detail. In step 200, control determines $A_{UNCOMP}$ based on driver and/or cruise control intent. In step 202, control determines whether the throttle is operating in the HI region. More specifically, $A_{UNCOMP}$ is compared to a HI threshold. If $A_{UNCOMP}$ is greater than or equal to the HI threshold, the throttle is operating in the HI region. If $A_{UNCOMP}$ is less than the HI threshold, the throttle is operating in the LO region. An exemplary value for the HI threshold is approximately 6%, although other values can be used. If the throttle is operating in the HI region control continues in step 204. If the throttle is not operating in the HI region, the throttle is operating in the LO region and control continues in step 206.

In step 204, control determines a $A_{CORR}$ from the HI region look-up table based on $A_{UNCOMP}$. In step 208, control determines whether $A_{CORR}$ is within a HI range. More specifically, $A_{CORR}$ is compared to an air learn positive limit ($LIM_{AIRLRNPOS}$) and an air learn negative limit ($LIM_{AIRLRNNEG}$). $LIM_{AIRLRNPOS}$ and $LIM_{AIRLRNNEG}$ are determined based on the throttle is operating in the HI region, as discussed in further detail below. If $A_{CORR}$ is greater than $LIM_{AIRLRNPOS}$ or less than $LIM_{AIRLRNNEG}$, $A_{CORR}$ is not within the HI range. This indicates a corrupted table value and all of the tables are reset in step 210. If $A_{CORR}$ is within the HI range, control continues in step 212.

In step 206, control determines a $A_{CORR}$ from the LO region look-up table based on $A_{UNCOMP}$. In step 214, control determines whether $A_{CORR}$ is within a LO range. More specifically, $A_{CORR}$ is compared to $LIM_{AIRLRNPOS}$ and $LIM_{AIRLRNNEG}$, which are determined based on the throttle operating in the LO region, as discussed in further detail below. If $A_{CORR}$ is greater than $LIM_{AIRLRNPOS}$ or less than $LIM_{AIRLRNNEG}$, $A_{CORR}$ is not within the LO range. This indicates a corrupted table value and all of the tables are reset in step 210. If $A_{CORR}$ is within the LO range, control continues in step 212.

In step 212, $A_{CORR}$ is saved in a second memory store as $A_{CORRDUAL}$. In step 216, control determines whether to rate limit $A_{CORR}$. $A_{CORR}$ is rate limited under certain operating conditions. In general, $A_{CORR}$ is rate limited when $A_{CORR}$ is greater than the difference between a maximum idle area ($A_{IDLEMAX}$) and an idle area ($A_{IDLE}$). In one operating condition, if the engine is operating under a power limited condition, $A_{CORR}$ is limited to the difference between $A_{IDLEMAX}$ and $A_{IDLE}$. A power limited condition can occur when one or more sensors, such as the TPS 28 or accelerator pedal position sensor 24, has a fault or when the throttle actuator has a fault. If the engine is not operating under the power limited condition, a corrected area rate ($A_{CORRATE}$) is calculated as the sum of an idle speed increase area ($A_{IDLESPDINC}$) and a previous $A_{CORR}$ (i.e., $A_{CORR}$ at the time step immediately previous to the current time step). If $A_{CORR}$ is greater than $A_{CORRATE}$, then $A_{CORR}$ is limited to the maximum value of either the difference between $A_{IDLEMAX}$ and $A_{IDLE}$ or $A_{CORRATE}$ in step 218.

In another operating condition, $A_{CORR}$ is rate limited when operating in the LO region and $A_{CORR}$ is greater than $A_{IDLEMAX}$. In this case, $A_{CORR}$ is limited to $A_{IDLEMAX}$ in step 218. In still another operating condition, $A_{CORR}$ is limited when operating in the HI region and $A_{CORR}$ is greater than the maximum HI region look-up table value. In this case, $A_{CORR}$ is limited to the maximum HI region look-up table value in step 218.

In step 220, control determines whether $A_{CORR}$ is equal to $A_{CORRDUAL}$. If $A_{CORR}$ is equal to $A_{CORRDUAL}$, then $A_{CORR}$ was not rate limited or limited to any maximum limits and learning is enabled in step 222. If $A_{CORR}$ is not equal to $A_{CORRDUAL}$, then $A_{CORR}$ from the HI region was rate limited or limited to a maximum limits and learning in the HI region is inhibited in step 224. In this manner, the tables are not updated using a MAF residual calculated from a rate limited throttle position value.

In step 226, control determines $A_{COMP}$ based on $A_{UNCOMP}$, $A_{CORR}$ and $A_{CORRDUAL}$. More specifically, $A_{COMP}$ is determined based on the following relationship:

$$A_{COMP}=\mathrm{MAX}(0, (A_{UNCOMP}+\mathrm{MIN}(A_{CORR}, A_{CORRDUAL})))$$

In this manner, $A_{COMP}$ can be limited to remain positive or is calculated using the minimum of $A_{CORR}$ and $A_{CORRDUAL}$. In step 228, control determines whether $A_{COMP}$ is equal to 0. If $A_{COMP}$ is equal to zero, $A_{COMP}$ is a limited value and control inhibits LO region learning in step 230. If $A_{COMP}$ is not equal to zero, $A_{COMP}$ is not a limited value and control enables LO region learning in step 232. In step 234, control determines throttle position (TP) based on $A_{COMP}$. It is anticipated that TP can be calculated or determined from a look-up table. Control regulates the throttle to achieve TP.

Figure 3:
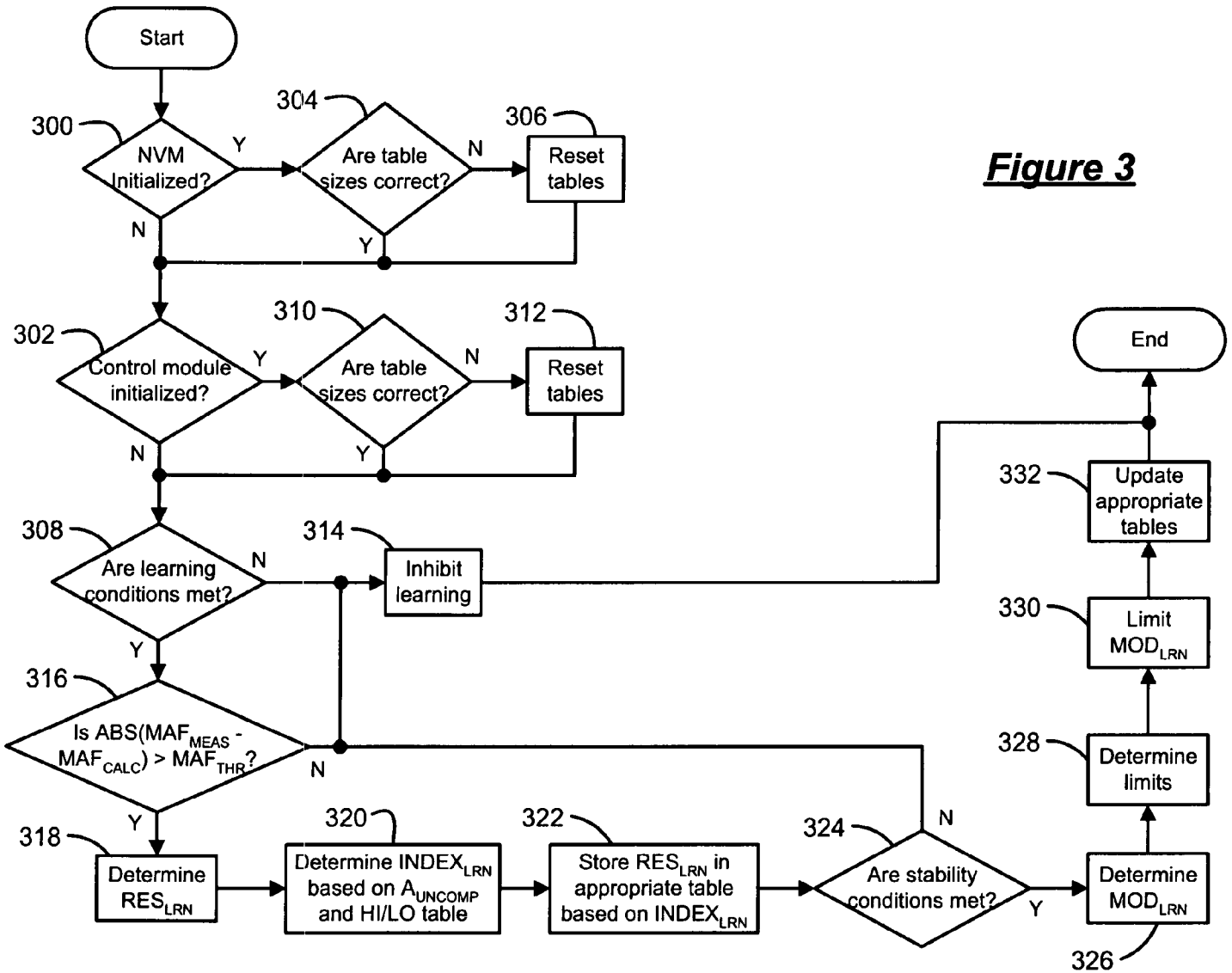
FIG. 3 is a flowchart illustrating steps performed by the throttle control system to update airflow correction and residual tables according to the present invention.

Referring now to FIG. 3, the updating or learning routine executed by the throttle control system will be discussed in detail. At the outset, it should be noted that the learning routine is not executed when learning is inhibited, as discussed above with reference to FIG. 2 and in further detail below. In step 300, control determines whether the non-volatile memory (NVM) was initialized. NVM can be initialized as a result of a power loss, such as a battery disconnect event and the like. If the NVM was not initialized, control continues in step 302. If the NVM was initialized, control determines whether the table sizes are correct in step 304. If the tables sizes are correct, control continues in step 302. If the table sizes are not correct, control resets the tables in step 306 and continues in step 302.

In step 302, control determines whether the control module was initialized. The control module is initialized at every vehicle power-up event (e.g., turning ignition on). If the control module was not initialized, control continues in step 308. If the control module was initialized, control determines whether the table sizes are correct in step 310. If the table sizes are correct, control continues in step 308. If the table sizes are not correct, control resets the tables in step 312 and continues in step 308.

In step 308, control determines whether the learning conditions are met. The learning conditions include ensuring that the engine has not run at idle for an extended period of time. If the engine is at idle for too long, the throttle body can become too warm, varying the intake air temperature (IAT), which in turn affects the accuracy of $MAF_{IND}$, described in further detail below. Other learning conditions include, but are not limited to, ensuring the engine is operating at steady state, ensuring that the MAF is not below a threshold value and ensuring that the barometer value was last updated within a threshold distance. Still other learning conditions include ensuring that the various sensors are functioning properly. Learning is inhibited if one or more sensors, such as the TPS 28 and pedal position sensor 24, has a fault, the throttle actuator has a fault or the learnt throttle minimums have been reset to default values. Other sensors including, but not lomited to, IAT, MAP, barometer, low battery voltage and MAF can inhibit learning if faulty. Idle speed faults including too low or too high of an engine idle speed can also inhibit learning. If the learning conditions are not met, control inhibits learning in step 314 and control ends. If the learning conditions are met, control continues in step 316.

In step 316, control ensures that neither the MAF and/or MAP sensors are shifted. More particularly, control determines whether the absolute value of the difference between $MAF_{MEAS}$ and $MAF_{CALC}$ is greater than a threshold ($MAF_{THR}$). If the absolute value of the difference is greater than $MAF_{THR}$, one of the MAP and/or MAF sensors is shifted. In this case, learning is inhibited in step 314 and control ends. If the absolute value of the difference is not greater than $MAF_{THR}$, neither the MAP nor MAF sensors is shifted and control continues in step 318.

In step 318, control determines a learning residual ($RES_{LRN}$) based on indicated MAF ($MAF_{IND}$) and $MAF_{MEAS}$. More particularly, $RES_{LRN}$ is an average of multiple residual values calculated at a current throttle position. $MAF_{IND}$ is determined based on the throttle position signal from the TPS and does not include any correction. Each residual value is provided as a unitless ratio and is calculated according to the following equation:

$$\text{Residual}=(MAF_{IND}-MAF_{MEAS})/MAF_{MEAS}$$

Several residual values are recorded and $RES_{LRN}$ is calculated when a threshold number of residual values are recorded. More specifically, $RES_{LRN}$ is calculated as the sum of the recorded residual values divided by the number of residual values.

In step 320, control determines a learning index or break point ($INDEX_{LRN}$) based on either the LO region or HI region tables, depending on whether the throttle is operating in the LO or HI regions, and $A_{UNCOMP}$. More specifically, $INDEX_{LRN}$ is interpolated from the appropriate table based on $A_{UNCOMP}$. Because $INDEX_{LRN}$ may lie between table indices, $INDEX_{LRN}$ is rounded to the nearest index. Control saves $RES_{LRN}$ in the corresponding table at $INDEX_{LRN}$, replacing the previous table value in step 322.

In step 324, control checks a sub-set of the stability conditions to ensure the samples used to update the tables are stable and valid. The sub-set of stability conditions include, but are not limited to engine speed being within a threshold range, time since last learn being greater than a threshold time, a vacuum across the throttle blade being greater than a threshold value and $A_{UNCOMP}$ being less than a threshold value. If the stability conditions are not met, control inhibits learning in step 314 and control ends. If the stability conditions are met, control continues in step 326.

In step 326, control determine an air learn modifier ($MOD_{LRN}$). $MOD_{LRN}$ is a throttle area correction determined based on $RES_{LRN}$ and is discussed in further detail below with regard to FIG. 4. In step 328, control determines lower and upper limits. ($LIM_{LOWER}$,$LIM_{UPPER}$), as discussed in further detail below with regard to FIGS. 5A and 5B. In step 330, control limits $MOD_{LRN}$ based on $LIM_{LOWER}$ and $LIM_{UPPER}$, as discussed in further detail below with regard to FIG. 6. In step 332, control updates the appropriate table and control ends.

Figure 4:
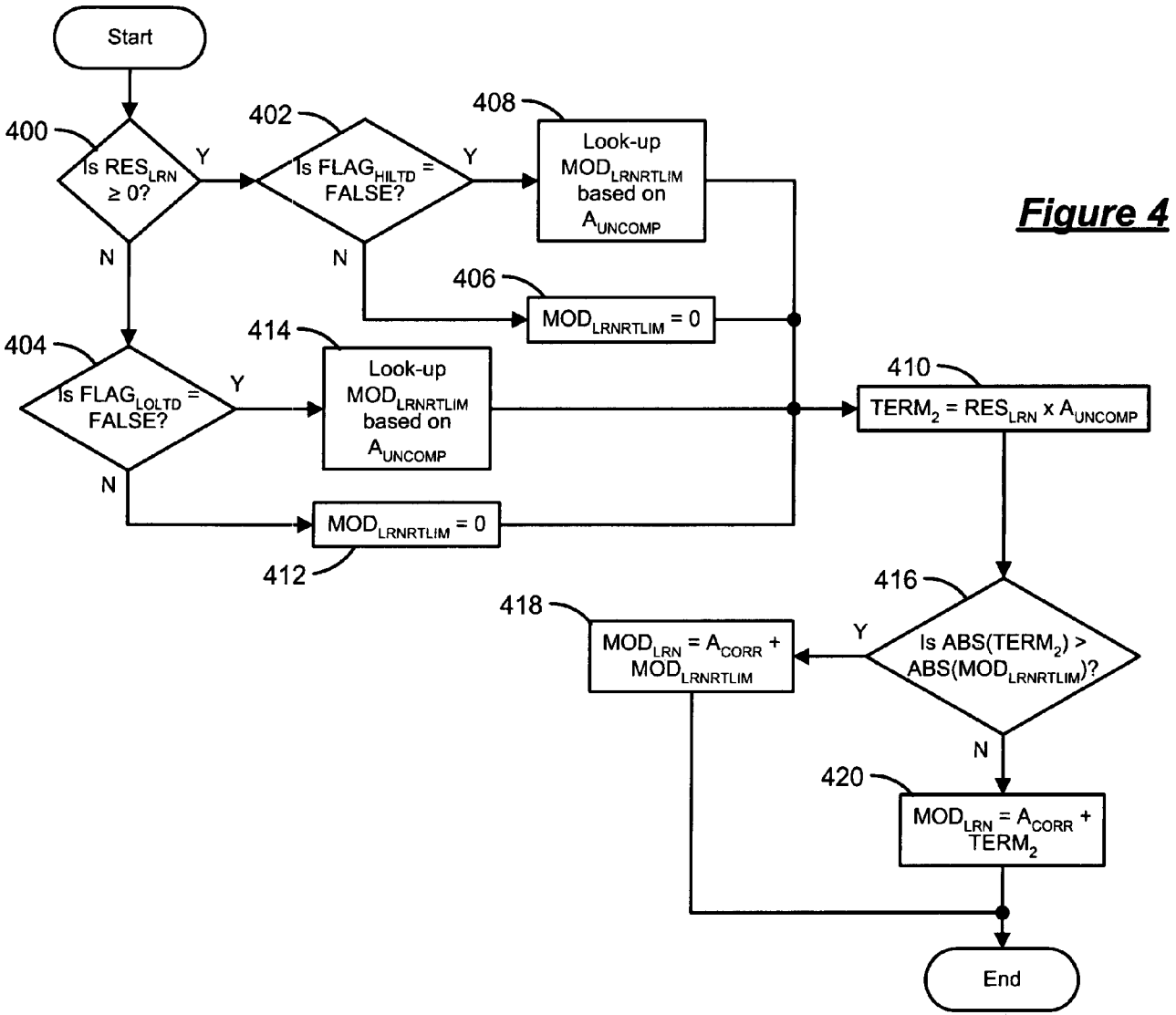
FIG. 4 is a flowchart illustrating steps performed by the throttle control system to determine an air learn modifier according to the present invention.

Referring now to FIG. 4, the steps executed by the throttle control system to determine $MOD_{LRN}$ will be discussed in detail. In step 400, control determines whether $RES_{LRN}$ is greater than or equal to 0. If $RES_{LRN}$ is greater than or equal to 0, control continues in step 402. If $RES_{LRN}$ is not greater than or equal to 0, control continues in step 404. In step 402, control determines whether $FLAG_{HILTD}$ is equal to FALSE. If $FLAG_{HILTD}$ is not equal to FALSE, learning higher correction terms is inhibited and control continues in step 406. If $FLAG_{HILTD}$ is equal to FALSE, learning higher correction terms is enabled and control continues in step 408. In step 406, control sets a learn rate limit modifier ($MOD_{LRNRTLIM}$) equal to 0 and control continues in step 410. In step 408, control looks up $MOD_{LRNRTLIM}$ from a look-up table based on $A_{UNCOMP}$. This look-up table provides values for the maximum allowable throttle area correction increase per learning cycle. In this manner, control ensures the throttle area correction is small enough to avoid idle instability, but large enough to provide an effective learning value.

In step 404, control determines whether $FLAG_{LOLTD}$ is equal to FALSE. If $FLAG_{LOLTD}$ is not equal to FALSE, learning lower correction terms is inhibited and control continues in step 412. If $FLAG_{LOLTD}$ is equal to FALSE, learning higher correction terms is enabled and control continues in step 414. In step 412, control sets $MOD_{LRNRTLIM}$ equal to 0 and control continues in step 410. In step 414, control looks up $MOD_{LRNRTLIM}$ from a look-up table based on $A_{UNCOMP}$. This look-up table provides values for the maximum allowable throttle area correction decrease per learning cycle. In this manner, control ensures the throttle area correction is small enough to avoid idle instability, but large enough to provide an effective learning value for a new or clean throttle.

In step 410, control calculates a second term ($TERM_2$) as the product of $RES_{LRN}$ and $A_{UNCOMP}$. In step 416, control determines whether the absolute value of $TERM_2$ is greater than the absolute value of $MOD_{LRNRTLIM}$. If the absolute value of $TERM_2$ is greater than the absolute value of $MOD_{LRNRTLIM}$, control continues in step 418. If the absolute value of $TERM_2$ is not greater than the absolute value of $MOD_{LRNRTLIM}$, control continues in step 420. In step 418, control calculates $MOD_{LRN}$ as the sum of $A_{CORR}$ and $MOD_{LRNRTLIM}$ and control ends. In step 420, control calculates $MOD_{LRN}$ as the sum of $A_{CORR}$ and $TERM_2$ and control ends.

Figure 5A:
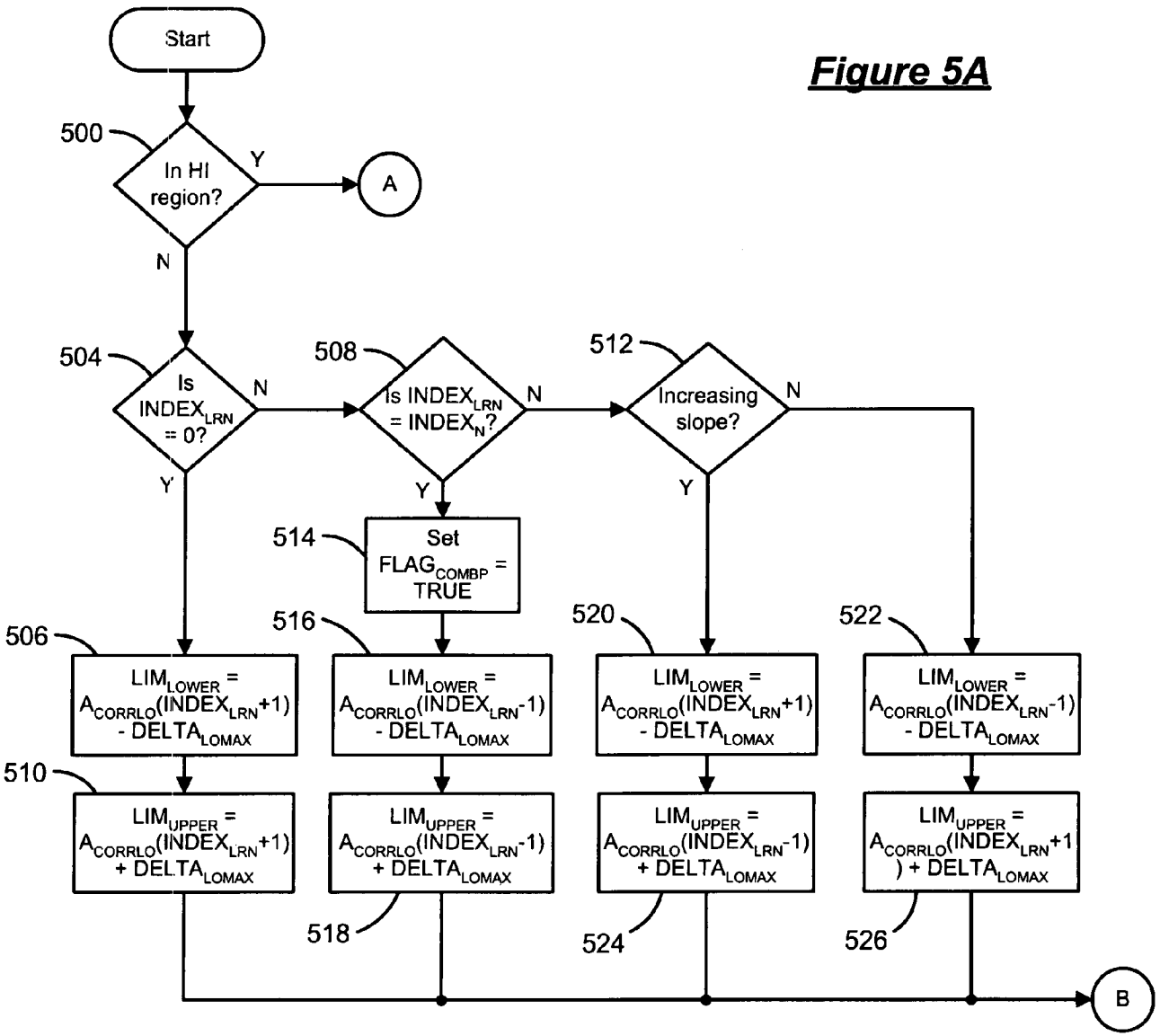
FIGS. 5A and 5B provide a flowchart illustrating steps performed by the throttle control system to determine high and low limits for the air learn modifier according to the present invention.
Figure 5B:
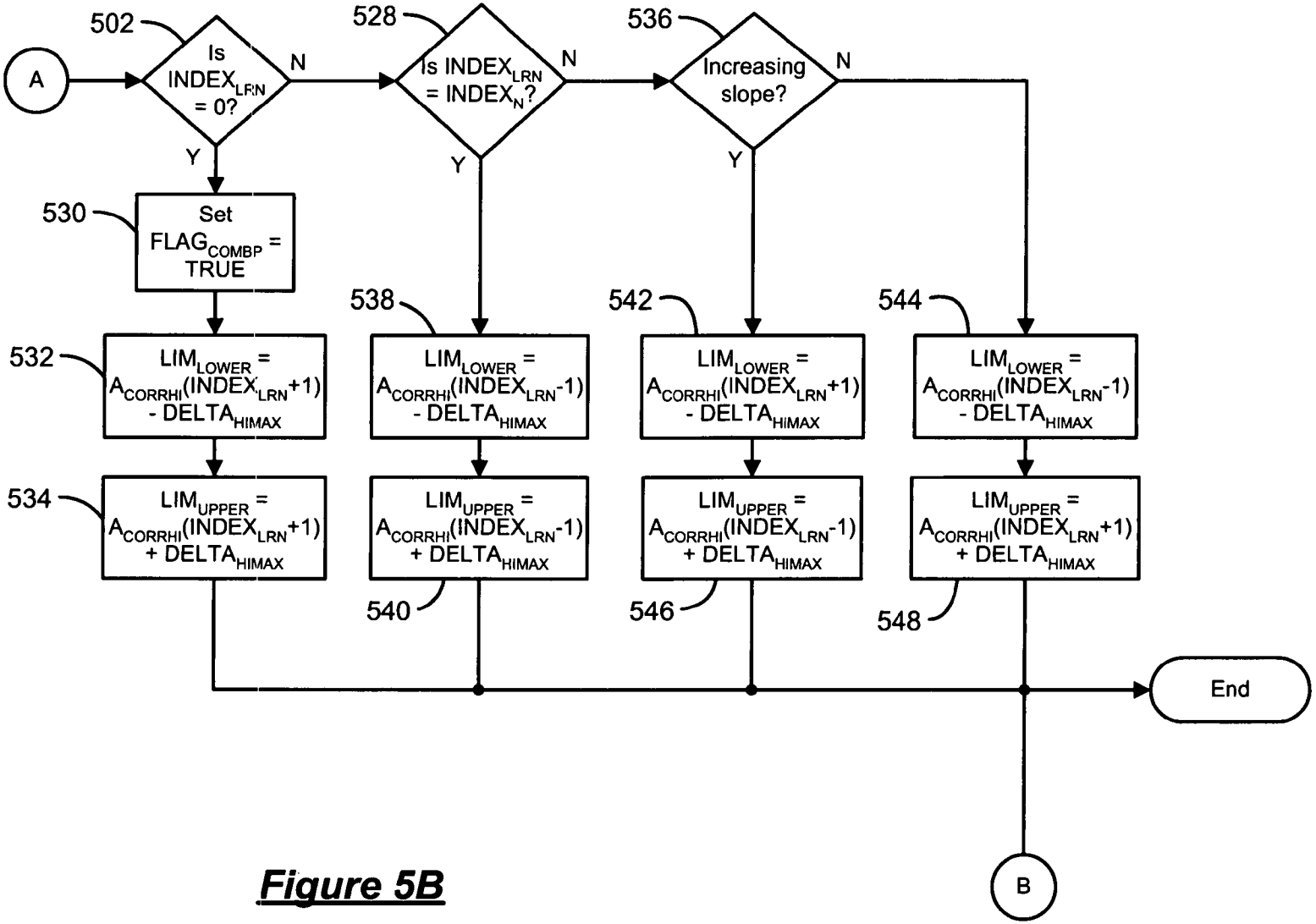

Referring now to FIGS. 5A and 5B, the steps executed by the throttle control system to determine $LIM_{LOWER}$ and $LIM_{UPPER}$ will be described in detail. Although not illustrated, a common break point flag ($FLAG_{COMBP}$) is initially set equal to FALSE. In step 500, control determines whether the throttle is operating in the HI region. If the throttle is operating in the HI region, control continues in step 502 of FIG. 5B. If the throttle is not operating in the HI region, control determines whether $INDEX_{LRN}$ is =0 in step 504. If $INDEX_{LRN}$ is equal to 0, $INDEX_{LRN}$ corresponds to the first index or break point of the LO region look-up table and control continues in step 506. If $INDEX_{LRN}$ is not equal to 0, $INDEX_{LRN}$ does not correspond to the first index or break point of the LO region look-up table and control continues in step 508.

In step 506, control calculates $LIM_{LOWER}$ according to the following equation:

$$LIM_{LOWER}=A_{CORRLO}(INDEX_{LRN}+1)-DELTA_{LOMAX}$$

In this manner, $LIM_{LOWER}$ is equal to the next highest correction value in the LO region look-up table, minus a maximum delta ($DELTA_{LOMAX}$) that is a calibration value corresponding to the LO region. In step 510, control calculates $LIM_{UPPER}$ according to the following equation:

$$LIM_{UPPER}=A_{CORRLO}(INDEX_{LRN}+1)+\text{DELTA}_{LOMAX}$$

In this manner, $LIM_{UPPER}$ is equal to the next highest correction value in the table, plus $DELTA_{LOMAX}$.

In step 508, control determines whether $INDEX_{LRN}$ is equal to $INDEX_n$. If $INDEX_{LRN}$ is not equal to $INDEX_n$, $INDEX_{LRN}$ is not equal to the last index value in the LO region look-up table and control continues in step 512. If $INDEX_{LRN}$ is equal to $INDEX_n$, $INDEX_{LRN}$ is equal to the last index value in the LO region look-up table and control continues in step 514. Because $INDEX_n$ of the LO region look-up table and $INDEX_0$ of the HI region look-up table are common to both tables as a result of overlap, $INDEX_{LRN}$ is considered a common index or break point. In step 514, control sets a common break point flag ($FLAG_{COMBP}$) equal to TRUE. In step 516, control calculates $LIM_{LOWER}$ according to the following equation:

$$LIM_{LOWER}=A_{CORRLO}(INDEX_{LRN}-1)-DELTA_{LOMAX}$$

In this manner, $LIM_{LOWER}$ is equal to the next lowest correction value in the table, minus $DELTA_{LOMAX}$. In step 518, control calculates $LIM_{UPPER}$ according to the following equation:

$$LIM_{UPPER}=A_{CORRLO}(INDEX_{LRN}-1)+DELTA_{LOMAX}$$

In this manner, $LIM_{UPPER}$ is equal to the next lowest correction value in the table, plus $DELTA_{LOMAX}$.

In step 512, control determines whether the look-up table is an increasing slope table. More specifically, if $A_{CORRLO}$ corresponding to the index immediately above $INDEX_{LRN}$ is greater than $A_{CORRLO}$ corresponding to the index immediately below $INDEX_{LRN}$, the look-up table is considered to be increasing in slope. If $A_{CORRLO}$ corresponding to the index immediately above $INDEX_{LRN}$ is not greater than $A_{CORRLO}$ corresponding to the index immediately below $INDEX_{LRN}$, the look-up table is considered to be decreasing in slope. If the look-up table is increasing in slope, control continues in step 520. If the look-up table is decreasing in slope, control continues in step 522.

In step 520, control calculates $LIM_{LOWER}$ according to the following equation:

$$LIM_{LOWER}=A_{CORRLO}(INDEX_{LRN}+1)-DELTA_{LOMAX}$$

In this manner, $LIM_{LOWER}$ is equal to the next highest correction value in the table, minus $DELTA_{LOMAX}$. In step 524, control calculates $LIM_{UPPER}$ according to the following equation:

$$LIM_{UPPER}=A_{CORRLO}(INDEX_{LRN}-1)+DELTA_{LOMAX}$$

In this manner, $LIM_{UPPER}$ is equal to the next lowest correction value in the table, plus $DELTA_{LOMAX}$. In step 522, control calculates $LIM_{LOWER}$ according to the following equation:

$$LIM_{LOWER}=A_{CORRLO}(INDEX_{LRN}-1)-DELTA_{LOMAX}$$

In this manner, $LIM_{LOWER}$ is equal to the next lowest correction value in the table, minus $DELTA_{LOMAX}$. In step 526, control calculates $LIM_{UPPER}$ according to the following equation:

$$LIM_{UPPER}=A_{CORRLO}(INDEX_{LRN}+1)+DELTA_{LOMAX}$$

In this manner, $LIM_{UPPER}$ is equal to the next highest correction value in the table, plus $DELTA_{LOMAX}$.

In step 502, control determines whether $INDEX_{LRN}$ is equal to 0. If $INDEX_{LRN}$ is not equal to 0, control continues in step 528. If $INDEX_{LRN}$ is equal to 0, $INDEX_{LRN}$ is equal to the first break point of the HI region look-up table and control continues in step 530. Because $INDEX_0$ of the HI region look-up table and $INDEX_n$ of the LO region look-up table are common to both tables as a result of overlap, $INDEX_{LRN}$ is considered a common index or break point. In step 530, control sets $FLAG_{COMBP}$ equal to TRUE. In step 532, control calculates $LIM_{LOWER}$ according to the following equation:

$$LIM_{LOWER}=A_{CORRHI}(INDEX_{LRN}+1)-DELTA_{HIMAX}$$

In this manner, $LIM_{LOWER}$ is equal to the next highest correction value in the HI region look-up table, minus a maximum delta ($DELTA_{HIMAX}$) that is a calibration value corresponding to the HI region. In step 534, control calculates $LIM_{UPPER}$ according to the following equation:

$$LIM_{UPPER}=A_{CORRHI}(INDEX_{LRN}+1)+DELTA_{HIMAX}$$

In this manner, $LIM_{UPPER}$ is equal to the next highest correction value in the table, plus $DELTA_{HIMAX}$.

In step 528, control determines whether $INDEX_{LRN}$ is equal to $INDEX_n$ (i.e., the last index or break point in the HI region look-up table). If $INDEX_{LRN}$ is not equal to $INDEX_n$, control continues in step 536. If $INDEX_{LRN}$ is equal to $INDEX_n$, control continues in step 538. In step 538, control calculates $LIM_{LOWER}$ according to the following equation:

$$LIM_{LOWER}=A_{CORRHI}(INDEX_{LRN}-1)-DELTA_{HIMAX}$$

In this manner, $LIM_{LOWER}$ is equal to the next lowest correction value in the table, minus $DELTA_{HIMAX}$. In step 540, control calculates $LIM_{UPPER}$ according to the following equation:

$$LIM_{UPPER}=A_{CORRHI}(INDEX_{LRN}-1)+DELTA_{HIMAX}$$

In this manner, $LIM_{UPPER}$ is equal to the next lowest correction value in the table, plus $DELTA_{HIMAX}$.

In step 536, control determines the look-up table is an increasing slope table. More specifically, if $A_{CORRHI}$ corresponding to the index immediately above $INDEX_{LRN}$ is greater than $A_{CORRHI}$ corresponding to the index immediately below $INDEX_{LRN}$, the look-up table is considered to be increasing in slope. If $A_{CORRHI}$ corresponding to the index immediately above $INDEX_{LRN}$ is not greater than $A_{CORRHI}$ corresponding to the index immediately below $INDEX_{LRN}$, the look-up table is considered to be decreasing in slope. If the look-up table is increasing in slope, control continues in step 542. If the look-up table is decreasing in slope, control continues in step 544.

In step 542, control calculates $LIM_{LOWER}$ according to the following equation:

$$LIM_{LOWER}=A_{CORRHI}(INDEX_{LRN}+1)-DELTA_{HIMAX}$$

In this manner, $LIM_{LOWER}$ is equal to the next highest correction value in the table, minus $DELTA_{HIMAX}$. In step 546, control calculates $LIM_{UPPER}$ according to the following equation:

$$LIM_{UPPER}=A_{CORRHI}(INDEX_{LRN}-1)+DELTA_{HIMAX}$$

In this manner, $LIM_{UPPER}$ is equal to the next lowest correction value in the table, plus $DELTA_{HIMAX}$. In step 544, control calculates $LIM_{LOWER}$ according to the following equation:

$$LIM_{LOWER}=A_{CORRHI}(INDEX_{LRN}-1)-DELTA_{HIMAX}$$

In this manner, $LIM_{LOWER}$ is equal to the next lowest correction value in the table, minus $DELTA_{HIMAX}$. In step 548, control calculates $LIM_{UPPER}$ according to the following equation:

$$LIM_{UPPER}=A_{CORRHI}(INDEX_{LRN}+1)+DELTA_{HIMAX}$$

In this manner, $LIM_{UPPER}$ is equal to the next highest correction value in the table, plus $DELTA_{HIMAX}$.

Figure 6:
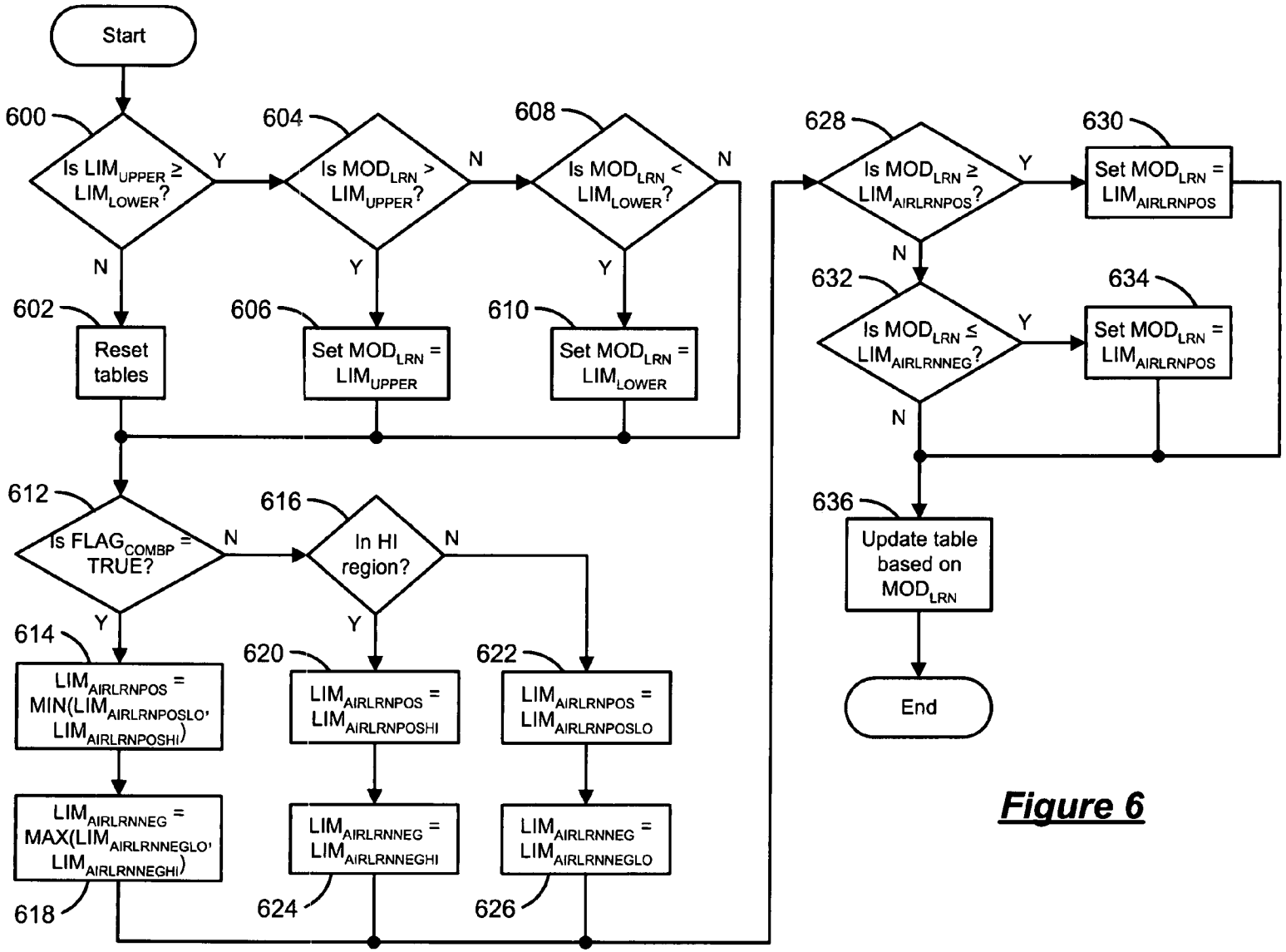
FIG. 6 is a flowchart illustrating steps performed by the throttle control system to limit the air learn modifier according to the present invention.

Referring now to FIG. 6, the steps executed by the throttle control system to determine $LIM_{AIRLRNPOS}$ and $LIM_{AIRLRNNEG}$ and to limit $MOD_{LRN}$ based thereon will be described in detail. In step 600, control determines whether $LIM_{UPPER}$ is greater than or equal to $LIM_{LOWER}$. This check ensures the integrity of the values because $LIM_{UPPER}$ should always be equal to or greater than $LIM_{LOWER}$. If $LIM_{UPPER}$ is not greater than or equal to $LIM_{LOWER}$, control resets the tables in step 602. If $LIM_{UPPER}$ is greater than or equal to $LIM_{LOWER}$, control determines whether $MOD_{LRN}$ is greater than $LIM_{UPPER}$ in step 604. If $MOD_{LRN}$ is greater than $LIM_{UPPER}$, control limits $MOD_{LRN}$ by setting $MOD_{LRN}$ equal to $LIM_{UPPER}$ in step 606. If. $MOD_{LRN}$ is not greater than $LIM_{UPPER}$, control determines whether $MOD_{LRN}$ is less than $LIM_{LOWER}$ in step 608. If $MOD_{LRN}$ is less than $LIM_{LOWER}$, control limits $MOD_{LRN}$ by setting $MOD_{LRN}$ equal to $LIM_{LOWER}$ in step 610. If $MOD_{LRN}$ is not less than $LIM_{LOWER}$, control continues in step 612.

In step 612, control determines whether $FLAG_{COMBP}$ is equal to TRUE. If $FLAG_{COMBP}$ is equal to TRUE, control continues in step 614. If $FLAG_{COMBP}$ is not equal to TRUE, control continues in step 616. In step 614, control determines $LIM_{AIRLRNPOS}$ according to the following equation:

$$LIM_{AIRLRNPOS}=\mathrm{MIN}(LIM_{AIRLRNPOSLO}, LIM_{AIRLRNPOSHI})$$

In step 618, control determines $LIM_{AIRLRNNEG}$ according to the following equation:

$$LIM_{AIRLRNNEG}=\mathrm{MAX}(LIM_{AIRLRNNEGLO}, LIM_{AIRLRNNEGHI})$$

In step 616, control determines whether the throttle is operating in the HI region. If the throttle is operating in the HI region, control continues in step 620. If the throttle is not operating in the HI region, control continues in step 622. In step 620, control sets $LIM_{AIRLRNPOS}$ equal to $LIM_{AIRLRNPOSHI}$. In step 624, control sets $LIM_{AIRLRNNEG}$ equal to $LIM_{AIRLRNNEGHI}$. In step 622, control sets $LIM_{AIRLRNPOS}$ equal to $LIM_{AIRLRNPOSLO}$. In step 626, control sets $LIM_{AIRLRNNEG}$ equal to $LIM_{AIRLRNNEGLO}$.

In step 628, control determines whether $MOD_{LRN}$ is greater than or equal to $LIM_{AIRLRNPOS}$. If $MOD_{LRN}$ is greater than or equal to $LIM_{AIRLRNPOS}$, control limits $MOD_{LRN}$ by setting $MOD_{LRN}$ equal to $LIM_{AIRLRNPOS}$ in step 630. If $MOD_{LRN}$ is not greater than or equal to $LIM_{AIRLRNPOS}$, control determines whether $MOD_{LRN}$ is less than or equal to $LIM_{AIRLRNNEG}$ in step 632. If $MOD_{LRN}$ is less than or equal to $LIM_{AIRLRNNEG}$, control limits $MOD_{LRN}$ by setting $MOD_{LRN}$ equal to $LIM_{AIRLRNNEG}$ in step 634. If $MOD_{LRN}$ is less than or equal to $LIM_{AIRLRNNEG}$, control continues in step 636. In step 636, control updates the look-up table based on $INDEX_{LRN}$ and $MOD_{LRN}$. If operating in the LO region, the LO region look-up table is updated. If operating in the HI region, the HI region look-up table is updated. If $INDEX_{LRN}$ is a common index or break point, both the LO region and HI region look-up tables are updated.

Figure 7:
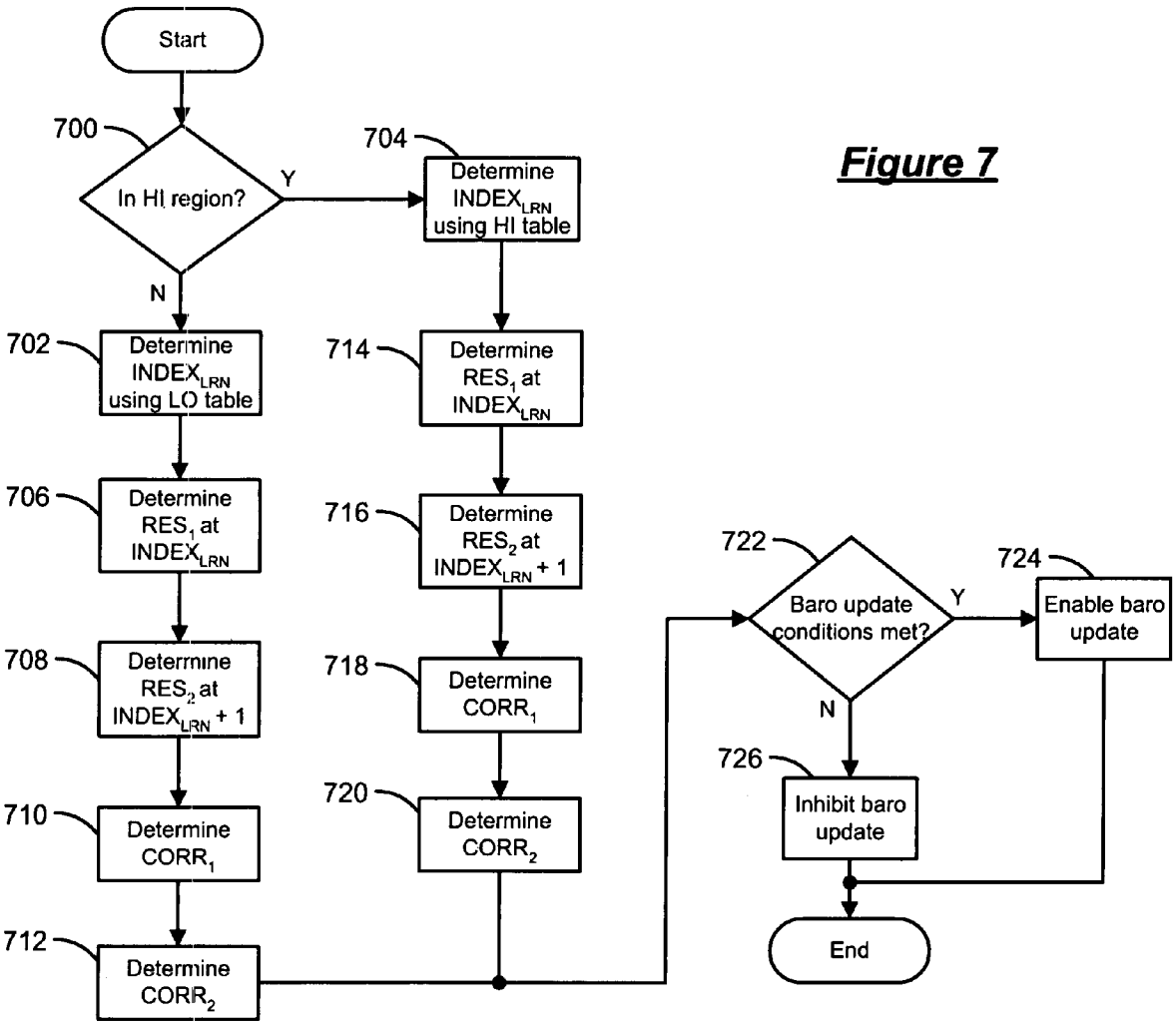
FIG. 7 is a flowchart illustrating steps performed by the throttle control system to enable a part throttle barometer update according to the present invention.

Referring now to FIG. 7, the throttle control system of the present invention enables periodic part throttle barometer updates. In step 700, control determines whether the throttle is operating in the HI region. If the throttle is not operating in the HI region, control continues in step 702. If the throttle is operating in the HI region, control continues in step 704. In step 702, control determines $INDEX_{LRN}$ from the LO region look-up table. In this case, $INDEX_{LRN}$ is not rounded to the nearest index to permit control to examine table values immediately above and below $INDEX_{LRN}$. In step 706, control determines a first residual index ($RES_1$) from the LO region residual look-up table based on $INDEX_{LRN}$. In step 708, control determines a second residual index ($RES_2$) from the LO region residual look-up table based on $INDEX_{LRN}$ plus one (i.e., the next higher index). In step 710 control determines a first correction value ($CORR_1$) from a LO region correction look-up table based on $INDEX_{LRN}$. Control determines a second correction value ($CORR_2$) from the LO region correction look-up table based on $INDEX_{LRN}$ plus one (i.e., the next higher index) in step 712.

In step 704, control determines $INDEX_{LRN}$ from the HI region look-up table. In step 714, control determines RES, from the HI region residual look-up table based on $INDEX_{LRN}$. In this case, $INDEX_{LRN}$ is not rounded to the nearest index to permit control to examine table values immediately above and below $INDEX_{LRN}$. In step 716, control determines $RES_2$ from the HI region residual look-up table based on $INDEX_{LRN}$ plus one (i.e., the next higher index). In step 718 control determines $CORR_1$ from a HI region correction look-up table based on $INDEX_{LRN}$. Control determines $CORR_2$ from the HI region correction look-up table based on $INDEX_{LRN}$ plus one (i.e., the next higher index) in step 720.

In step 722, control determines whether barometer update conditions have been met. The barometer update conditions include, but are not limited to, the distance since the last unthrottled barometer update being above a threshold, $CORR_1$ and $CORR_2$ being not equal zero, and both RES, and $RES_2$ being less than a barometer update enable threshold. If the barometer update conditions are met, control enables a barometer update routine in step 724 and control ends. If the barometer update conditions are not met, control inhibits the barometer update routine in step 726 and control ends. In this manner, the throttle control system checks both the residual look-up table and the correction look-up table to ensure that airflow variation has been learnt and sufficiently compensated before enabling a partial-throttle barometer update.

The throttle control system of the present invention provides the capability to perform airflow learning and retrieval in both the LO region and the HI region using limits tailored to each region. Another advantage includes expanded MAF table ranges and an expanded MAP based airflow versus MAF based airflow correlation test. The throttle control system further includes the ability to simultaneously learn common break points or indices in both the LO region and HI region look-up tables and uses smaller magnitude limiting at the common index. Further, the throttle control system resets or clears all four look-up tables (i.e., LO/HI region correction look-up tables and LO/HI region residual look-up tables) on initialization if any table sized is wrong.

The throttle control system of the present invention also implements a dual store for the correction term (i.e., $A_{CORRDUAL}$) to increase security and protection against memory corruption and allow higher correction ability by always picking the minimum of the rate limited correction term and the non-rate limited dual store correction term. By using stored residuals airflow variation is reduced to enable part-throttle barometer updates.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A throttle control system for a vehicle, comprising:

a driver input device that generates a control signal;

a control module that generates a throttle control signal based on said control signal, that determines whether said throttle control signal is within one of a first and a second region, that determines a compensation factor from a first look-up table when said throttle control signal is within said first region, that determines said compensation factor from a second look-up table when said throttle control signal is within said second region and that calculates a compensated throttle control signal based on said compensation factor.

2. The throttle control system of claim 1 further comprising a throttle that is regulated based on said compensated throttle control signal.

3. The throttle control system of claim 1 wherein said driver input device includes one of an accelerator pedal and a cruise control system.

4. The throttle control system of claim 1 wherein said control module stores said compensation factor in first and second memory stores, determines whether to rate limit said compensation factor and compares compensation factor values from said first and second stores to determine whether said compensation factor was rate limited.

5. The throttle control system of claim 1 wherein said control module checks learning conditions, updates said first look-up table based on a mass air flow (MAF) residual when said learning conditions are met and said throttle control signal is in said first region and updates said second look-up table based on said MAF residual when said learning conditions are met and said throttle control signal is in said second region.

6. The method of claim 5 wherein said control module updates said first and second tables based on said MAF residual when said learning conditions are met and an update index is common to both said first and second tables.

7. The throttle control system of claim 5 further comprising a MAF sensor that generates a measured MAF signal, wherein said MAF residual is calculated based on said measured MAF signal.

8. The throttle control system of claim 5 further comprising a manifold absolute pressure (MAP) sensor that generates a measured MAP signal, wherein said MAF residual is calculated based on said measured MAP signal.

9. The throttle control system of claim 5 wherein said control module updates a first residual look-up table based on said MAF residual when said learning conditions are met and said throttle control signal is in said first region and updates a second residual look-up table based on said MAF residual when said learning conditions are met and said throttle control signal is in said second region.

10. The throttle control system of claim 1 wherein said control module determines a first mass air flow (MAF) residual from a residual look-up table, determines a second MAF residual from said residual look-up table and enables a barometer update routine when said first and second MAF residuals are each less than a barometer update enable threshold.

11. The throttle control system of claim 1 wherein said control module determines a first correction value from said first look-up table, determines a second correction value from said first look-up table and enables a barometer update routine when said first and second correction values are not equal to zero.

12. The throttle control system of claim 1 wherein said control module resets said first and second look-up tables when a size of at least one of said first and second look-up tables is not equal to a predetermined value.

13. The throttle control system of claim 1 wherein said control module resets said first and second look-up tables when said compensation factor is outside of a threshold range.

14. The throttle control system of claim 13 wherein said control module determines upper and lower limits of said threshold range.

15. A method of compensating a throttle control signal for variation in air flow through a throttle, comprising:

generating said throttle control signal;

determining whether said throttle control signal is within one of a first and a second region;

determining a compensation factor from a first look-up table when said throttle control signal is within said first region;

determining said compensation factor from a second look-up table when said throttle control signal is within said second region;

calculating a compensated throttle control signal based on said compensation factor; and regulating said throttle based on said compensated throttle control signal.

16. The method of claim 15 further comprising:

storing said compensation factor in first and second memory stores;

determining whether to rate limit said compensation factor; and comparing compensation factor values from said first and second stores to determine whether said compensation factor was rate limited.

17. The method of claim 15 further comprising:

checking learning conditions;

updating said first look-up table based on a mass air flow (MAF) residual when said learning conditions are met and said throttle control signal is in said first region; and updating said second look-up table based on said MAF residual when said learning conditions are met and said throttle control signal is in said second region.

18. The method of claim 17 further comprising updating said first and second tables based on said MAF residual when said learning conditions are met and an update index is common to both said first and second tables.

19. The method of claim 17 further comprising calculating said MAF residual based on a measured MAF and an indicated MAF.

20. The method of claim 19 further comprising calculating said indicated MAF based on a manifold absolute pressure (MAP).

21. The method of claim 17 further comprising:

updating a first residual look-up table based on said MAF residual when said learning conditions are met and said throttle control signal is in said first region; and updating a second residual look-up table based on said MAF residual when said learning conditions are met and said throttle control signal is in said second region.

22. The method of claim 15 further comprising:

determining a first mass air flow (MAF) residual from a residual look-up table;

determining a second MAF residual from said residual look-up table; and enabling a barometer update routine when said first and second MAF residuals are each less than a barometer update enable threshold.

23. The method of claim 15 further comprising resetting said first and second look-up tables when a size of at least one of said first and second look-up tables is not equal to a predetermined value.

24. The method of claim 15 further comprising resetting said first and second look-up tables when said compensation factor is outside of a threshold range.

25. The method of claim 24 further comprising determining upper and lower limits of said threshold range.

26. A method of compensating a throttle control signal for variation in air flow through a throttle, comprising:

determining whether said throttle control signal is within one of a first and a second region;

determining a compensation factor from a first look-up table when said throttle control signal is within said first region;

determining said compensation factor from a second look-up table when said throttle control signal is within said second region;

calculating a compensated throttle control signal based on said compensation factor;

updating one of said first and second look-up tables based on a first mass air flow (MAF) residual; and enabling a barometer update routine based on said compensation factor and said MAF residual.

27. The method of claim 26 further comprising:

storing said compensation factor in first and second memory stores;

determining whether to rate limit said compensation factor; and comparing compensation factor values from said first and second stores to determine whether said compensation factor was rate limited.

28. The method of claim 26 further comprising checking learning conditions, wherein said step of updating occurs when said learning conditions are met.

29. The method of claim 26 wherein said first look-up table is updated when said throttle control signal is in said first region and said second look-up table is updated when said throttle control signal is in said second region.

30. The method of claim 26 wherein said first and second look-up tables are updated when an update index is common to both said first and second look-up tables.

31. The method of claim 26 further comprising calculating said MAF residual based on a measured MAF and an indicated MAF.

32. The method of claim 31 further comprising calculating said indicated MAF based on a manifold absolute pressure (MAP).

33. The method of claim 26 further comprising updating a first residual look-up table based on said MAF residual when said throttle control signal is in said first region.

34. The method of claim 26 further comprising updating a second residual look-up table when said throttle control signal is in said second region.

35. The method of claim 26 further comprising:

determining said first MAF residual from a residual look-up table; and determining a second MAF residual from said residual look-up table, wherein said step of enabling a barometer update routine occurs when said first and second MAF residuals are each less than a barometer update enable threshold.

36. The method of claim 26 further comprising resetting said first and second look-up tables when a size of at least one of said first and second look-up tables is not equal to a predetermined value.

37. The method of claim 26 further comprising resetting said first and second look-up tables when said compensation factor is outside of a threshold range.

* * * * *